US010047420B2

(12) United States Patent
Schroers et al.

(10) Patent No.: US 10,047,420 B2
(45) Date of Patent: Aug. 14, 2018

(54) MULTI STEP PROCESSING METHOD FOR THE FABRICATION OF COMPLEX ARTICLES MADE OF METALLIC GLASSES

(71) Applicant: YALE UNIVERSITY, New Haven, CT (US)

(72) Inventors: Jan Schroers, Hamden, CT (US); Thomas M. Hodges, North Haven, CT (US); Michael Kanik, Houston, TX (US); Punnathat Bordeenithikasem, New Haven, CT (US)

(73) Assignee: YALE UNIVERSITY, New Haven, CT (US)

( * ) Notice: Subject to any disclaimer, the term of this patent is extended or adjusted under 35 U.S.C. 154(b) by 397 days.

(21) Appl. No.: 14/385,349

(22) PCT Filed: Mar. 15, 2013

(86) PCT No.: PCT/US2013/032033

§ 371 (c)(1),
(2) Date: Sep. 15, 2014

(87) PCT Pub. No.: WO2013/138710

PCT Pub. Date: Sep. 19, 2013

(65) Prior Publication Data

US 2015/0068648 A1 Mar. 12, 2015

Related U.S. Application Data

(60) Provisional application No. 61/678,869, filed on Aug. 2, 2012, provisional application No. 61/611,742, filed on Mar. 16, 2012.

(51) Int. Cl.
*C22C 45/00* (2006.01)
*C21D 7/13* (2006.01)
(Continued)

(52) U.S. Cl.
CPC ..... *C22C 45/00* (2013.01); *B21J 1/006* (2013.01); *C21D 7/13* (2013.01); *C22C 1/002* (2013.01);
(Continued)

(58) Field of Classification Search
None
See application file for complete search history.

(56) References Cited

U.S. PATENT DOCUMENTS 5,296,059 A * 3/1994 Masumoto ..... B22F 3/006 148/403
8,348,495 B2 1/2013 Kamiya
(Continued)

FOREIGN PATENT DOCUMENTS

DE 102011001783 10/2012
DE 102011001784 10/2012
(Continued)

OTHER PUBLICATIONS

J.P. Patterson and D.R.H. Jones, Materials Research Bulletin 13 (6), p. 583-585 (1978).
(Continued)

*Primary Examiner* — George Wyszomierski
(74) *Attorney, Agent, or Firm* — R. Neil Sudol; Henry D. Coleman

(57) ABSTRACT

In one embodiment, the invention provides a process for thermoplastic forming of a metallic glass. For example, in one embodiment, the invention provides a process for thermoplastic forming of a metallic glass ribbons having a thickness of between about 50 to about 200 microns. Related articles of manufacture and processes for customizing articles in accordance with the process as described herein are also provided.

21 Claims, 11 Drawing Sheets

(A)

| START: | STEP 1 | STEP 1A | STEP 2 | STEP 2A..... | .....STEP N | END |
|---|---|---|---|---|---|---|
| Amorphous metallic glass feedstock | $T = T^1_{hom}$ $X_1 < X_{CRYST}$ | $T = T_{amb}$ $X_{1a} = 0$ | $T = T^2_{hom}$ $X_1 + X_2 < X_{CRYST}$ | $T = T_{amb}$ $X_{2a} = 0$ | $T = T^n_{hom}$ $\sum_{i=1}^{n} X_i < X_{CRYST}$ | Quenching or controlled cooling or annealing |
| | | STEP 1B $T = T_{amb}$ $X_{1b} = 0$ | | STEP 2B $T = T_{amb}$ $X_{2b} = 0$ | | |
| | | Step 1K $\sum_{j=1}^{k} X_{1j} = 0$ | | STEP 2M $\sum_{j=1}^{m} X_{2j} = 0$ | | |

EXAMPLE (B)

| START: | STEP I | STEP II* | STEP 3 | STEP 4** | END |
|---|---|---|---|---|---|
| Amorphous metallic glass feedstock | $T = T^1_{hom}$ Y X | $T = T^2_{hom}$ Z X | CURL RIBBON $T = T^3_{hom}$ | Anneal curled ribbon to smoothen the surface | Create final stage of material by cooling rate or annealing |
| | | Metallic glass Fixture F | | | |
| | $X_1 < X_{CRYST}$ | $X_1 + X_2 < X_{CRYST}$ | $X_1 + X_2 + X_3 < X_{CRYST}$ | | |

* STEP II can be replaced by grinding at $T = T_{amb}$

** STEP 4 is optimal

(51) Int. Cl.

| | |
|---|---|
| ***B21J 1/00*** | (2006.01) |
| ***C22C 1/00*** | (2006.01) |
| ***C22F 1/00*** | (2006.01) |
| ***C22F 1/14*** | (2006.01) |

(52) U.S. Cl.
CPC ..... *C22C 45/003* (2013.01); *C22F 1/00* (2013.01); *C22F 1/002* (2013.01); *C22F 1/14* (2013.01)

(56) References Cited

U.S. PATENT DOCUMENTS

| | | | | |
|---|---|---|---|---|
| 2008/0196794 | A1* | 8/2008 | Blandin | B32B 15/01 148/522 |
| 2011/0072873 | A1 | 3/2011 | Gritti et al. | |

FOREIGN PATENT DOCUMENTS

| | | | |
|---|---|---|---|
| JP | 09278456 | A | 10/1997 |
| WO | 03064076 | A1 | 8/2003 |
| WO | WO 2010/000081 | | 1/2010 |
| WO | 2012006571 | A2 | 1/2012 |

OTHER PUBLICATIONS

J. Schroers, Advances Materials 22, p. 1566-1597 (2010).
J. Schroers, Acta Materialia 56 (3), p. 471-478 (2008).
F. Spaepen, Acta Metallurgica 25 (4), p. 407-415 (1977).
J. Schroers, Y.Wu and W.L. Johnson, Philosophical Magazine a-Physics of Condensed Matter Structure and Mechanical Properties 82 (6), p. 1207-1217 (2002).
R. Martinez, G. Kumar and J. Schroers, Scripta Materialia 59 (2), p. 187-190 (2008).

* cited by examiner (A)

| START: | STEP 1 | STEP 1A | STEP 2 | STEP 2A..... | .....STEP N | END |
|---|---|---|---|---|---|---|
| Amorphous metallic glass feedstock | $T = T^1_{hom}$ $X_1 < X_{CRYST}$ | $T = T_{amb}$ $X_{1a} = 0$ | $T = T^1_{hom}$ $X_1 + X_2 < X_{CRYST}$ | $T = T_{amb}$ $X_{2a} = 0$ | $T = T^1_{hom}$ $\sum_{i=1}^{n} X_i < X_{CRYST}$ | Quenching or controlled cooling or annealing |
| | | STEP 1B | | STEP 2B | | |
| | | $T = T_{amb}$ $X_{1b} = 0$ | | $T = T_{amb}$ $X_{2b} = 0$ | | |
| | | Step 1K | | STEP 2M | | |
| | | $\sum_{j=1}^{k} X_{1j} = 0$ | | $\sum_{j=1}^{m} X_{2j} = 0$ | | |
| | | | | | | |

EXAMPLE (B)

| START: | STEP I | STEP II* | | STEP 3 | STEP 4** | END |
|---|---|---|---|---|---|---|
| | | | | CURL RIBBON | | |
| Amorphous metallic glass feedstock | $T = T^1_{hom}$ 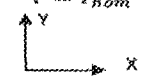  | $T = T^2_{hom}$ 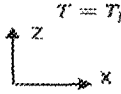  | | $T = T^3_{hom}$ | Anneal curled ribbon to smoothen the surface | Create final stage of material by cooling rate or annealing |
| 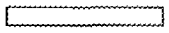 | 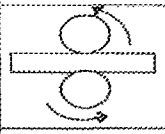 | 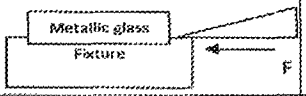  | | 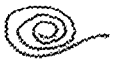 | | |
| | $X_1 < X_{CRYST}$ | $X_1 + X_2 < X_{CRYST}$ | | $X_1 + X_2 + X_3 < X_{CRYST}$ | | |

* STEP II can be replaced by grinding at $T = T_{amb}$

** STEP 4 is optimal

FIGURE 3

Figure 4: Shape of spiral that could be made with aforementioned methodology

LARGE SCALE

MULTI STEP PROCESSING METHOD FOR THE FABRICATION OF COMPLEX ARTICLES MADE OF METALLIC GLASSES

RELATED APPLICATIONS

This application is a 371 application of international patent application number PCT/US2013/032033 filed Mar. 15, 2013, which claims the benefit of priority of provisional application serial number U.S. 61/611,742, filed Mar. 16, 2012 and provisional application serial number U.S. 61/678,869, filed Aug. 2, 2012, both of identical title, the entire contents of each application being incorporated by reference in its entirety herein.

FIELD OF THE INVENTION

This invention describes a process for fabricating complex shapes out of a metallic glass by sequential thermoplastic forming (TPF) based processing.

BACKGROUND OF THE INVENTION

As described in U.S. Pat. No. 8,348,495, "a metallic glass alloy is an alloy that includes elements satisfying specific conditions and having a metallic element as a main component, and is an amorphous metal alloy with a disordered atomic-scale structure. Such metallic glass alloys are formed, for example, by cooling the molten raw materials at a critical cooling rate of 104 K/s or greater. The properties of these metallic glass alloys include high wear resistance, high strength, a low Young's modulus, and high corrosion resistance."

Thermoplastic forming (TPF) based processing has been already suggested in the early days of metallic glass research as a method for forming[1] and has been widely used ever since[2]. It is based on the existence of a supercooled liquid region, the temperature region above the glass transition temperature where the metallic glass former exists as a (supercooled) liquid before it eventually crystallizes during further heating. This supercooled liquid region (SCLR) in metallic glass formers, and thereby TPF, is unique among metals.

The maximum strain that can be achieved during TPF is called the formability (for given conditions, stress, geometry) and is limited by the metastable characteristic of the metallic glass (or when relaxed, the supercooled liquid region[3]). The formability of a metallic glass in its SCLR can be described by the maximum strain the MG can undergo before it eventually crystallizes. Under the assumption of Newtonian behavior, i.e., $$\sigma=\eta 3\dot{\varepsilon} \tag{1}$$

where $\sigma$ is the flow stress and $\dot{\varepsilon}$ is the strain rate and under isothermal conditions the maximum strain can be calculated by integrating Eq. (1) between 0 and $t_{cryst}$:

$$\dot{\varepsilon}dt = \int_0^{cryst} \frac{\sigma}{3\eta}\, dt \tag{2}$$

Thus the maximum strain achievable under isothermal conditions is given by:

$$\varepsilon_{max} = t_{cryst}\frac{\sigma}{3\eta} \tag{3}$$

Here, the isothermal formability is given by:

$$F = \frac{t_{cryst}}{3\eta} \tag{4}$$

DE102011001783 describes an amorphous strip material which is used as an elevator spring and which initially prepared with a melt spinning process, preferably as a continuous tape or film in a thickness of typically 50-200 μm. This amorphous strip material has a high strength and a low elastic modulus and can be made under normal atmospheric conditions; heat treatment under vacuum or inert gas is not required.

DE102011001784 describes an amorphous alloy which can be used, e.g. as an elevator spring and which preferably has a crystallization temperature $T_x$ of greater than 400° C., an amorphous ribbon material which is first produced with a melt spinning process as a continuous strip or foil with a thickness of, for example, about 40 to 200 μm. The amorphous alloy can be directly cast as amorphous ribbons by treatment steps providing a better and more uniform surface structure, in particular with a reduced surface roughness, and a smaller number of surface defects and defects, as well as a uniform, typically rectangular cross-section. In one process described in DE102011001784, shaping is performed by heat treatment, preferably at a temperature of between 0.3 to 0.7 $T_x$. This temperature range provides a sufficient diffusion of the required for the shaping relaxation, which is required for the embossing of a mainspring form. In this temperature range, there is no crystallization of the amorphous material, which would be accompanied by undesirable brittleness of the strip material. The duration of the heat treatment, depending on temperature, can be from one minute to four hours.

U.S. Pat. No. 8,348,496 describes a mainspring for a mechanism driven by a motor spring, especially for a timepiece, wherein the mainspring is a single monolithic metallic glass ribbon having a thickness greater than 50 μm, wherein the monolithic metallic glass ribbon has a spiral-shaped curvature in a free state of the mainspring. The ribbons intended to form the mainsprings are produced by using the quench wheel technique (also called planar flow casting), which is a technique for producing metal ribbons by rapid cooling. A jet of molten metal is propelled onto a rapidly rotating cold wheel. The speed of the wheel, the width of the injection slot and the injection pressure are parameters that define the width and thickness of the ribbon produced. Other ribbon production techniques may also be used, such as for example twin-roll casting. In the example described in U.S. Pat. No. 8,348,496, the alloy $Ni_{53}Nb_{20}Zr_8Ti_{10}Co_6Cu_3$ is used. 10 to 20 g of alloy are placed in a delivery nozzle heated to between 1050 and 1150° C. The width of the nozzle slot is between 0.2 and 0.8 mm. The distance between the nozzle and the wheel is between 0.1 and 0.3 mm. The wheel onto which molten alloy is deposited is a wheel made of a copper alloy and is driven with a tangential velocity ranging from 5 to 20 m/s. The pressure exerted to expel the molten alloy through the nozzle is between 10 and 50 kPa. The ribbons are subsequently formed into their final dimensions by grinding or wire electrical discharge machining (WEDM). Finished ribbons are formed by a fitting operation whereby the ribbon is heterogeneously deformed into the final shape and heated at a temperature T where $Tg-50<T<Tx+50$.

While known TPF processes such as those illustrated by DE102011001783, DE102011001784 and U.S. Pat. No. 8,348,496 provide a variety of ways to cast amorphous alloys, the need continues to exist for processes that deform amorphous alloy ribbons under conditions (temperature and strain rate) that result in homogenous deformation, thereby minimizing processing defects and enabling the manufacture of a variety of conventional or customized articles.

SUMMARY OF THE INVENTION

The present invention provides in part a process wherein an amorphous alloy workpiece or feedstock is deformed under conditions (temperature and strain rate) that result in homogenous deformation. The process minimizes processing defects and enables the manufacture of a variety of conventional or customized articles.

The present invention contemplates in part a process for the thermoplastic forming of an amorphous metal workpiece or feedstock, where the process comprises multiple treatment phases for respective time periods and at respective temperatures each equal to or greater than the glass transition temperature, where each treatment phase results in a respective individual crystallized volume fraction less than a predetermined minimal detectable crystallized volume fraction and where the sum total of the various individual crystallized volume fractions is less than the minimal detectable crystallized volume fraction. The treatment temperatures may vary in accordance with the types of treatment undertaken during the respective treatment phases. Thus an extruding treatment will require a high temperature, while a printing or embossing treatment will require only a low temperature. Moreover, consecutive thermoplastic forming phases may be separated by additional treatment phases at temperatures lower than the glass transition temperature. Such additional treatment phases do not increase the total crystallized volume fraction of the partially treated amorphous metal workpiece or feedstock.

The present invention is based on the existence of a supercooled liquid region, the temperature region above the glass transition temperature where the metallic glass former exists as a (supercooled) liquid before it eventually crystallizes during further heating. This supercooled liquid region (SCLR) in metallic glass formers, and thereby TPF, is unique among metals. The present invention enables working of an amorphous metal feedstock without causing the feedstock or workpiece to become crystallized beyond a minimally detectable amount.

The present invention recognizes that the crystallization of an amorphous metal workpiece in different treatment phases is cumulative so that undue crystallization can be avoided by ensuring that the sum total of individual crystallized volume fractions of the different treatment phases is less than the minimal detectable crystallized volume fraction.

The present invention also recognizes that different kinds treatments have minimal requisite temperatures and that total treatment time can be extended by limiting the temperatures of the different treatment phases to the respective minimum requisite temperatures, which minimizes the respective individual crystallized volume fractions.

Surprisingly, the inventors have discovered that the formability of metallic glasses always increases with temperature and as a result have developed novel processes for thermoplastic forming of a metallic glass. The processes of the present invention decouple cooling (to avoid crystallization) and deformation, which allows for no limitations in terms of ribbon thickness, shows negligible intrinsic scatter in $t_{cryst}^3$ and evidence low flow stresses in the homogeneous deformation region while being robust because impurities have negligible effects on $t_{cryst}^5$. Articles of manufacture made by these novel processes are also within the scope of the invention.

A process for thermoplastic forming of a metallic glass comprises, in accordance with the present invention, (a) providing an amorphous metallic glass feedstock, (b) heating the feedstock at a first temperature which is equal to or greater than the glass transition temperature of the feedstock so that the feedstock is in a supercooled liquid state, thereby enabling homogeneous deforming of the feedstock, (c) discontinuing heating of the feedstock and the deformation treatment while the crystallized volume fraction of the heated feedstock is less than a predetermined crystallized volume fraction, (d) after a predetermined interval, reheating the feedstock at a second temperature which is equal to or greater than the glass transition temperature of the feedstock so that the feedstock is in a supercooled liquid state, thereby enabling homogeneous deforming of the feedstock, (e) discontinuing reheating of the feedstock and the second deformation treatment while the total crystallized volume fraction of the heated feedstock is less than said predetermined crystallized volume fraction, and (f) optionally repeating steps (d) and (e) one or more times to enable deforming of the feedstock into a final predetermined geometry while maintaining the total crystallized volume fraction of the feedstock lower than the predetermined crystallized volume fraction.

Pursuant to the invention, there are two or more heat treatment periods each of which contributes to crystallization of the amorphous metal material. It is only necessary that the sum total of the crystallized volume fractions of the individual treatment periods treatment is less than a predetermined crystallized volume fraction, which is the minimum detectable crystallized volume fraction.

Pursuant to another feature of the present invention, the process includes subjecting the feedstock to a first deformation treatment during at least one of the steps of heating and reheating of the feedstock. The feedstock may be subjected to a second deformation treatment during the other step of heating and reheating of the feedstock. These deformation treatments may be different types of treatment (for instance, rolling and embossing or extruding and rolling). In that case, the first temperature and the second temperature are typically different predetermined values of temperature.

The predetermined crystallized volume fraction is preferably a minimal detectable crystallized volume fraction preferably between about 1% to about 10%, or about 2% to about 9%, or about 3% to about 8%, or about 4% to about 6%, or about 5% of total feedstock volume.

In another embodiment, the invention provides a process for thermoplastic forming of metallic glass ribbons, not limited in size, but having a typical thickness of 50 to about 200 microns, the process comprising the steps of:

(a) providing an amorphous metallic glass feedstock;

(b) homogeneously deforming the feedstock by heating the feedstock at a temperature which is equal to or greater than the glass transition temperature of the feedstock;

(c) discontinuing heating of the feedstock when the feedstock has a crystallized volume fraction of between about 1% to about 10%, or about 2% to about 9%, or about 3% to about 8%, or about 4% to about 6%, or about 5% of total feedstock volume;

(d) either quenching the feedstock or subjecting the feedstock to controlled cooling;

(e) optionally annealing the feedstock; and (f) subsequent homogeneous deformation by rolling the feedstock into ribbons while the feedstock is at a temperature equal to or greater than glass transition temperature of the feedstock material;

wherein during heating the feedstock exists as a supercooled liquid for a period of time prior to reaching a crystallized volume fraction of between about 1% to about 10%, or about 2% to about 9%, or about 3% to about 8%, or about 4% to about 6%, or about 5% of total feedstock volume.

In still another embodiment, the invention provides a process for the customization of an article comprised of an amorphous metallic glass, the process comprising subjecting the article to a process as described herein, wherein the article serves as the amorphous metallic glass feedstock and wherein subsequent to either quenching, controlled cooling or annealing, feedstock dimensions are compared to at least one reference value and the feedstock undergoes steps (a)-(d), and optionally step (e) as described above until differences between the feedstock dimensions and the at least one reference value fall within a tolerance range.

In still other embodiments, the invention provides a variety of articles of manufacture made by processes as described herein.

These and other aspects are described in the Detailed Description of the Invention.

BRIEF DESCRIPTION OF THE FIGURES

FIG. 3: A) Generic multi step processing method for the fabrication of complex articles made from metallic glass. The requirement for the processing steps are $$\sum_{i=1}^{N} x_i < x_{cryst}.$$

Each step can also be broken down in sub steps as long as $$\sum_{i=1}^{N} x_i < x_{cryst},\ x_i = \sum_{j=1}^{K} x_j.$$

In between processing steps that consume crystallization time, ($x_i \neq 0$), steps can be added that do not consume processing time, $x_i=0$. End "stage" of the metallic glass can be controlled by the cooling or annealing conditions. B) Specific process to fabricate main springs for mechanical watch movements based on TPF based processes. TPF based rolling, scraping, deformation, and surface smoothening are utilized for reliable, reproducible and precise fabrication of the main spring. The final cool or anneal can be utilized to manipulate properties further.

Figure 4:
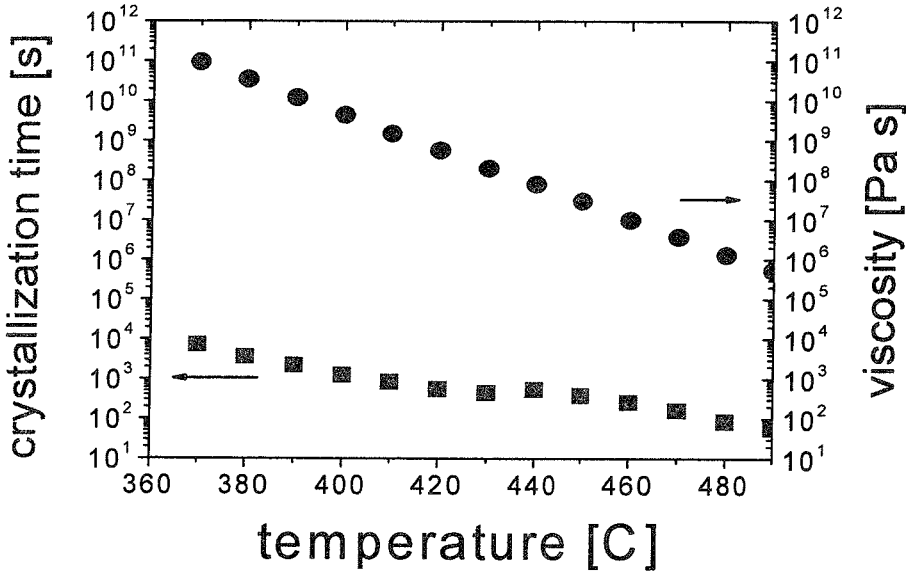

FIG. 4: Temperature dependence of viscosity and crystallization time for a Zr-based BMG.

Figure 5:
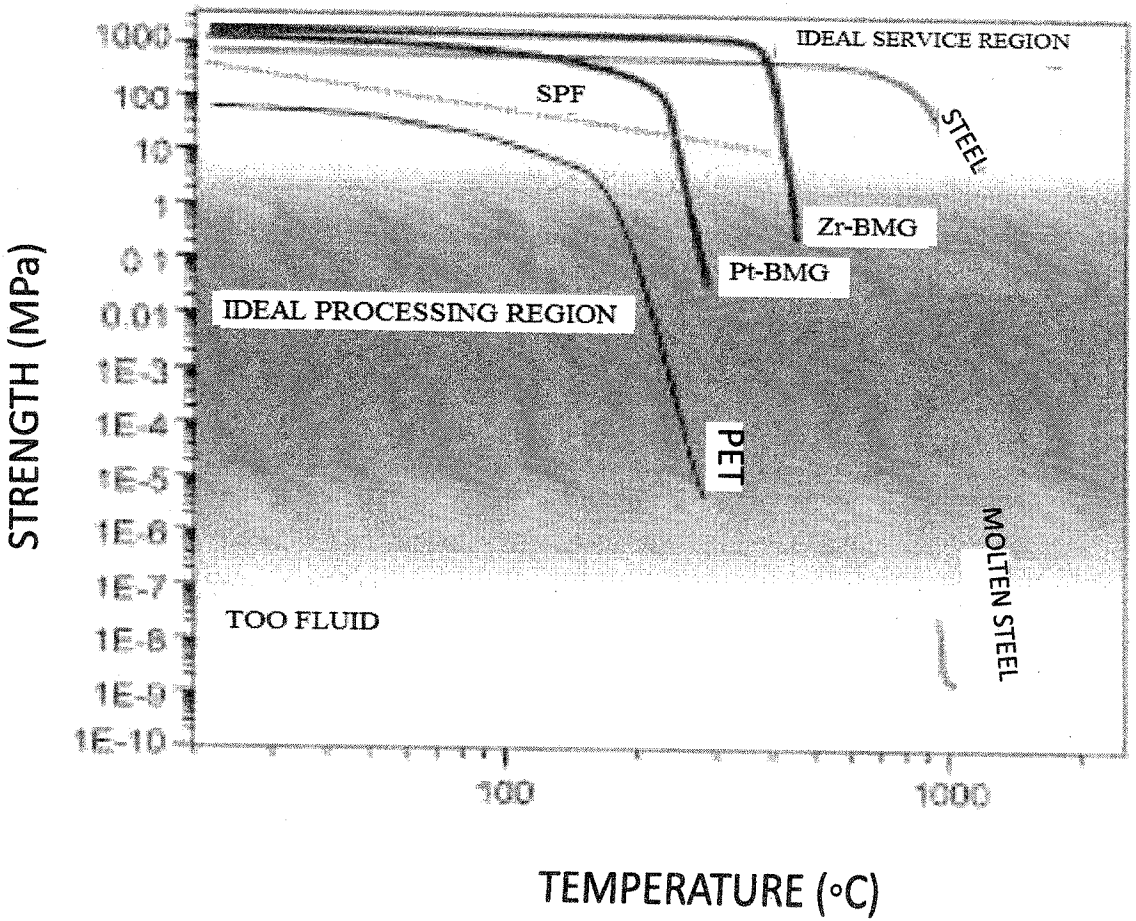

FIG. 5: Properties vs. processability compared via the temperature-dependent mechanical strength for conventional steel, plastics, and BMGs. The ideal processing region for TPF features a strength that is low enough to cause flow under modest pressure even though the material still retains its shape otherwise. A region with these characteristics (green area) can be accessed by plastics as well as by some of the recently developed highly processable BMGs, but not by conventional metals or SPF alloys. Compared to plastics, however, BMGs exhibit almost two orders of magnitude higher room temperature strength, making them the only plastically formable high-strength material class.

Figure 6:
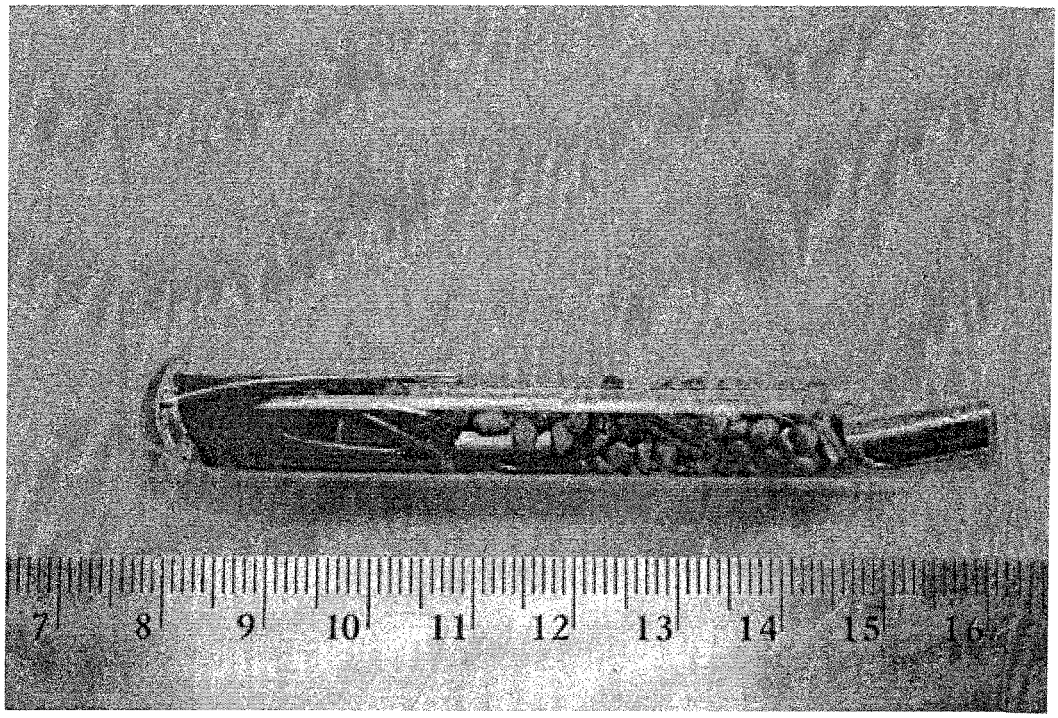

FIG. 6: Constituent elements weighed according to their respective weights before alloying, as illustrated in the experiment of Example 1.

Figure 7:
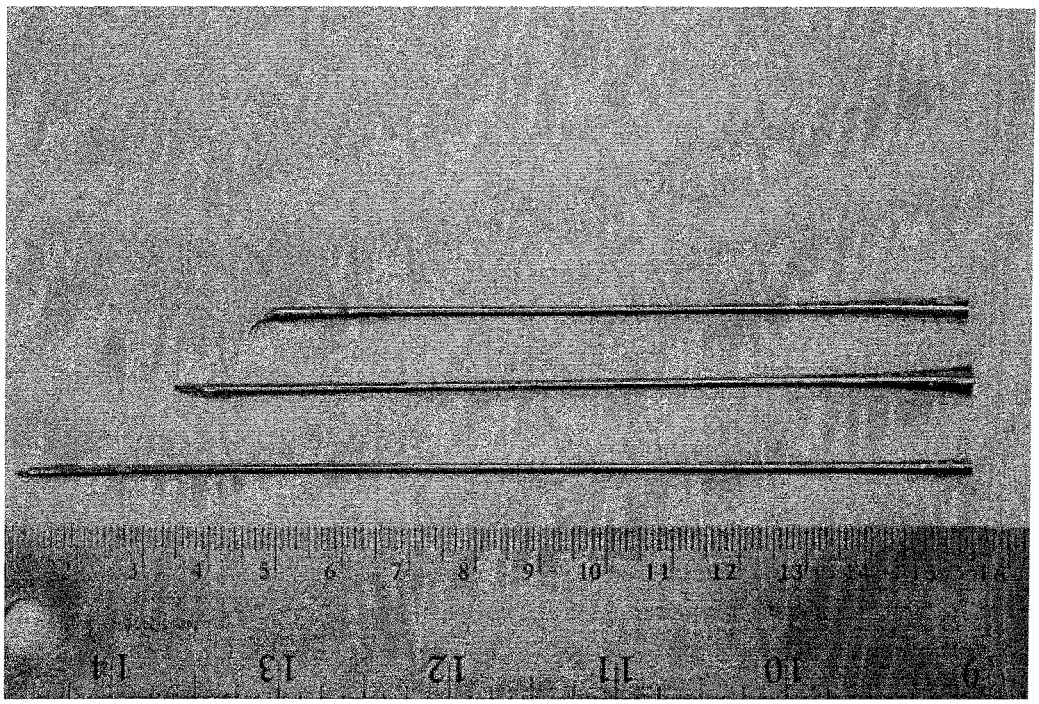

FIG. 7: As-cast alloys. Residual quartz that is wetted on the surface of the alloy can be seen, as illustrated in the experiment of Example 1.

Figure 8:
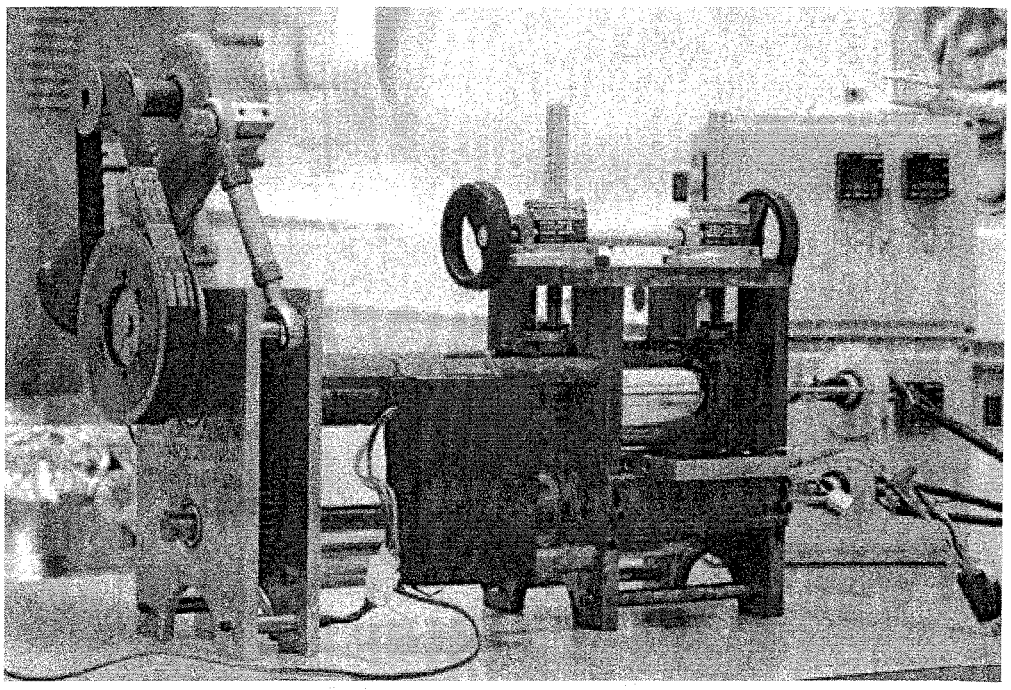

FIG. 8: Photograph of the rolling mill used. The brass plate is used for preheating the compound and feeding the feedstock into the rollers.

Figure 9:
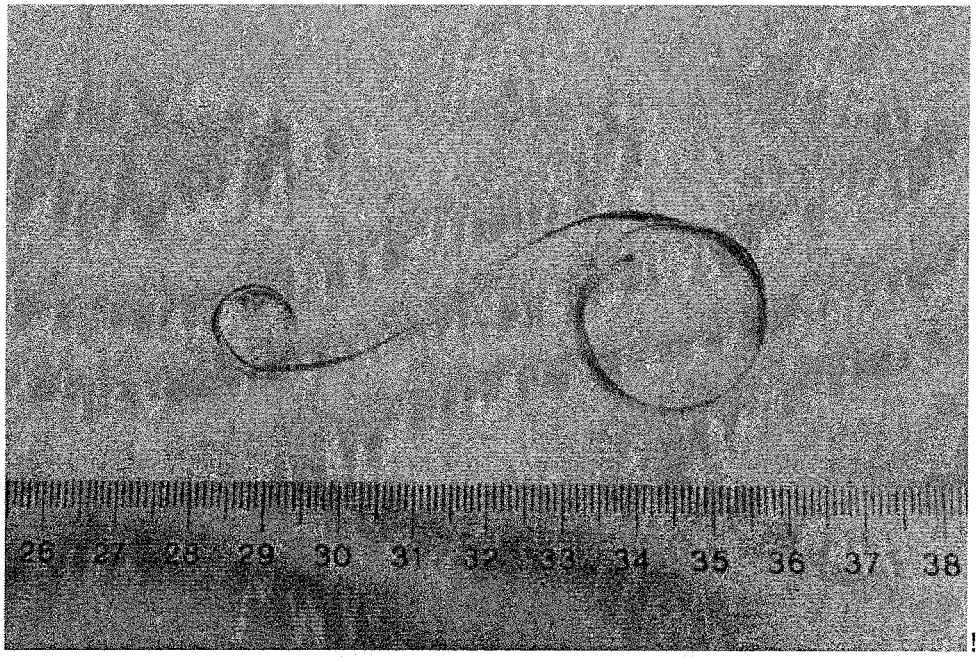

FIG. 9: Photograph of a mainspring spiral made in the experiment of Example 1.

Figure 10:
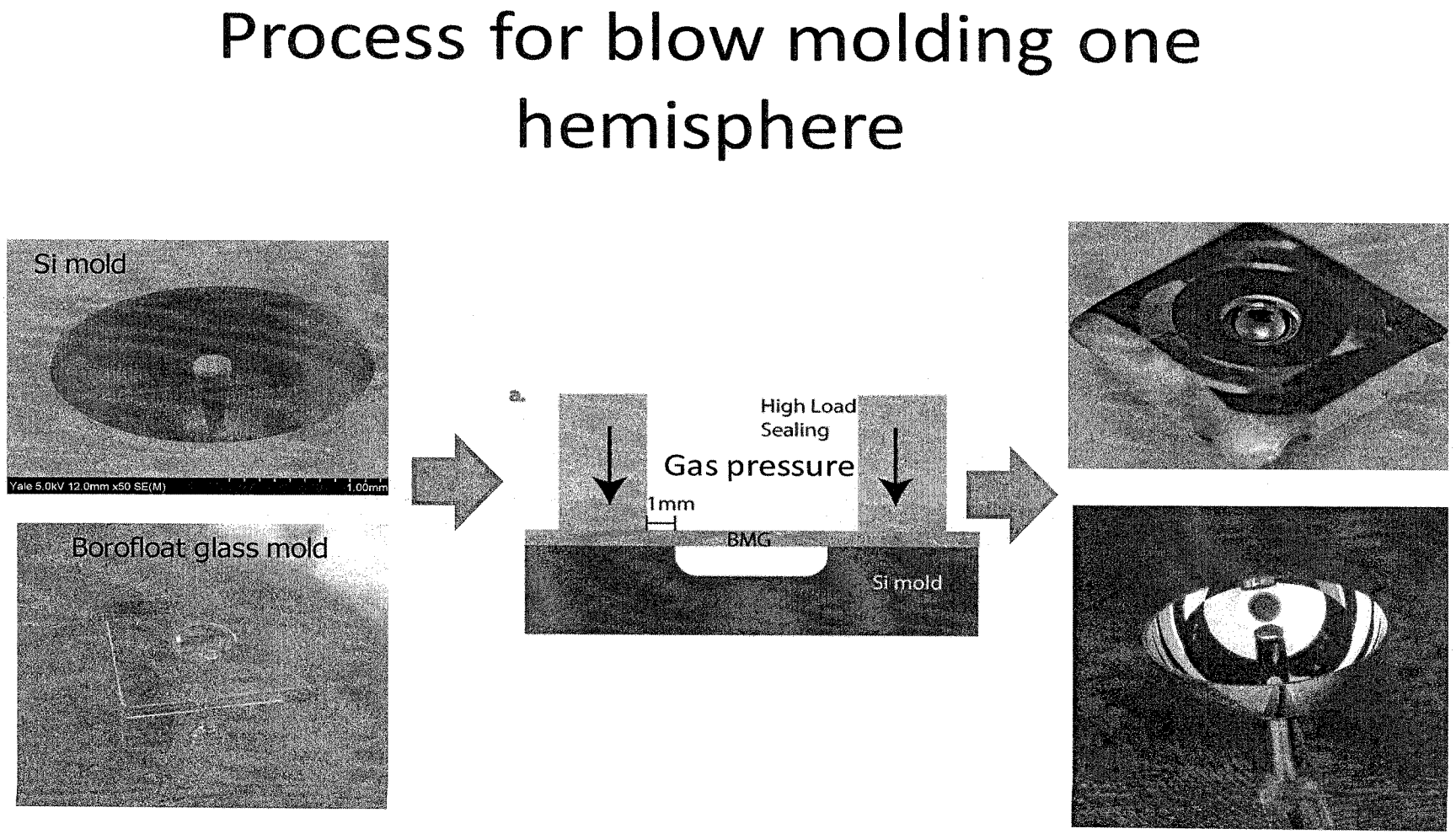

FIG. 10: Photographs showing molds, a diagram of a blow molding process in accordance with the invention, further photographs showing bimetallic glass sheets blow molded onto the molds.

Figure 11:
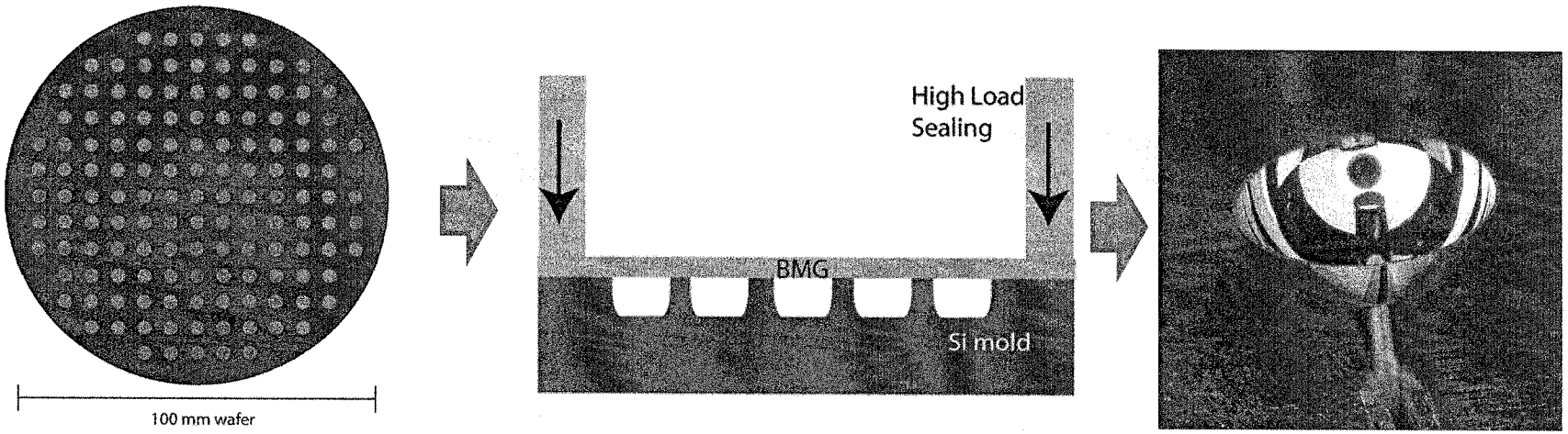

FIG. 11: A diagram of a large scale or batch molding process pursuant to the invention, and a photograph of an exemplary blow-molded unit in the batch process.

DETAILED DESCRIPTION OF THE INVENTION

During temperature exposure of the metallic glass it crystallizes (or develops toward crystallization) causing a crystallized volume fraction which depends on both temperature and time x(t, T). The onset of crystallization can be defined by a detectable volume fraction, $x_{cryst}(t, T)$, typically by x-ray diffraction or thermal analysis. In an isothermal experiment, T=To=const, for the crystallized volume fraction $x_{cryt}(t=t_{cryst}, T_o$. Typically, the detection level is around a few percent, for example 5%. Surprisingly we found that x(t, T) is cumulative. For example in an isothermal experiment, T=const and therefore $x \propto ct$ the $t_{cryst}$ is identical, $$\sum_{i=1}^{N} t_i = t_{cryst}$$

Figure 2:
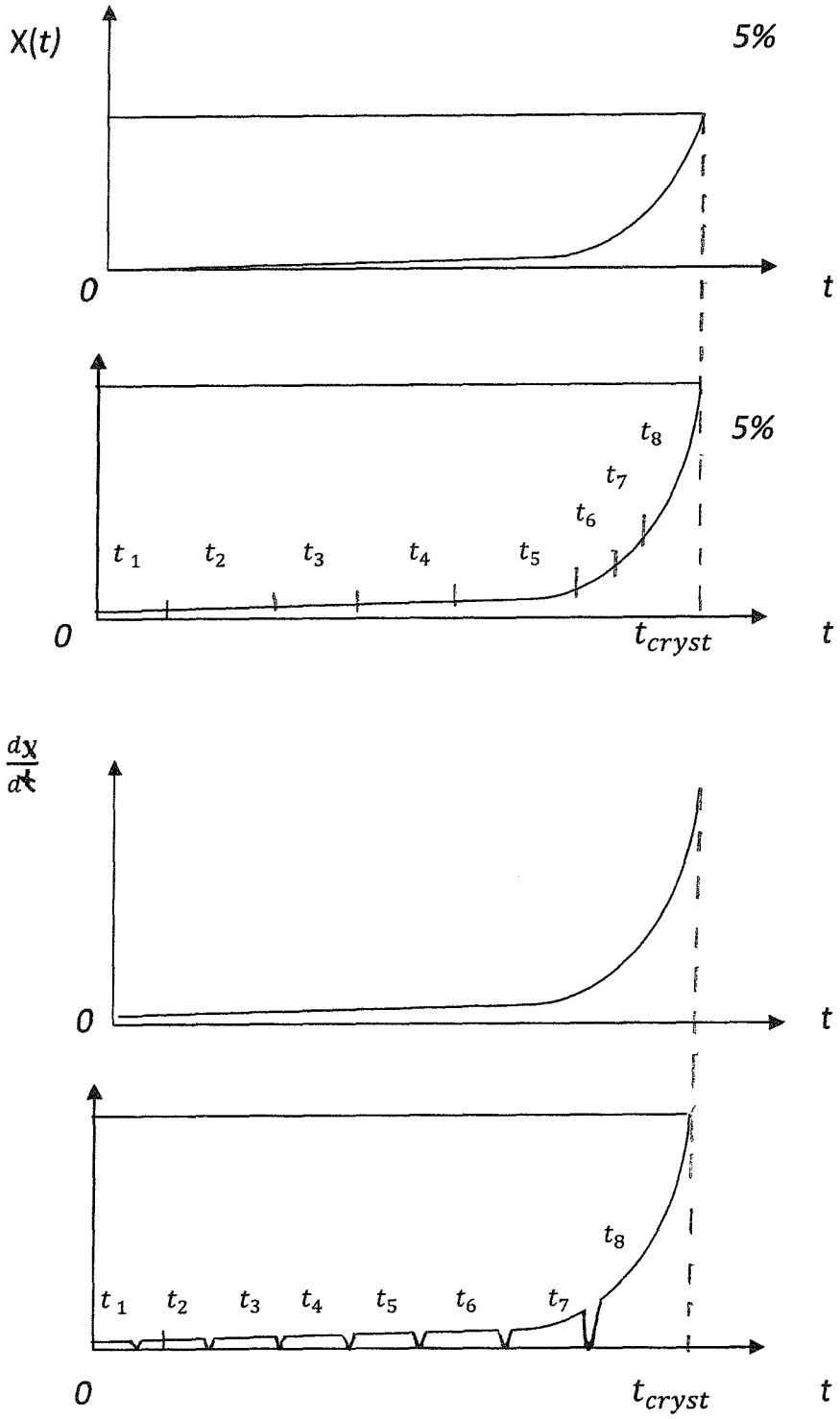
FIG. 2: Crystallization (top) is cumulative, thereby the available crystallization time can be broken down into many processing windows. Crystallization rate (bottom) shows similar cumulative behavior.

(FIG. 2). For example we found that when $Pd_{43}Ni_{10}Cu_{27}P_{20}$ is processed at 380° C. it takes 400 sec to crystallize. This time is undistinguishable from the cumulative time when the sample is heated (20 K/min, this heating time is not considered) to 380° C. and held there for 80 sec and cooled (with 40 K/min, this time is not considered) 5 times.

Figure 1:
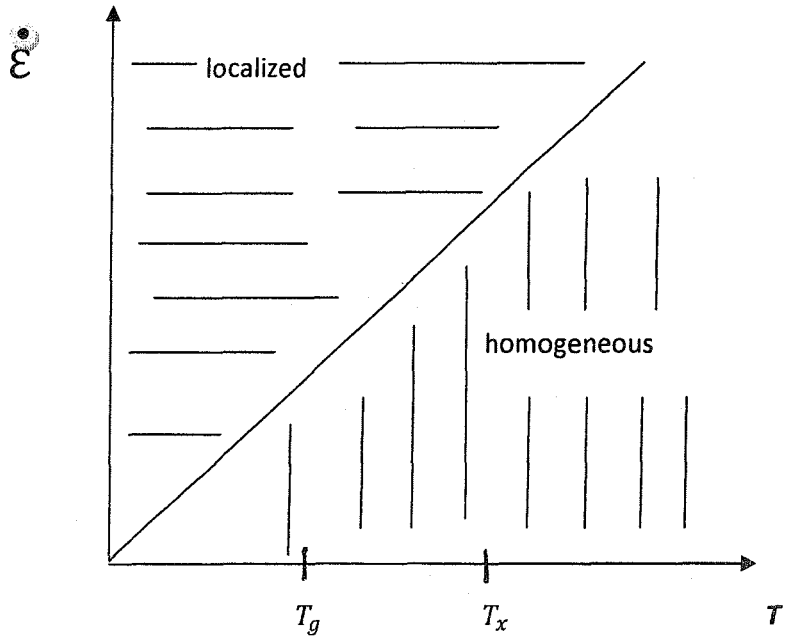
FIG. 1: Homogenous and shear localized deformation regions as a function of temperature.

Within this invention we utilize this cumulative and predictable property for multi-step TPF based processing methods. Metallic glasses exhibit dramatically different deformation modes depending on temperature and strain rate (FIG. 1). At low temperatures and high strain rates, the deformation of metallic glasses is localized in shear bands whereas with increasing temperature or decreasing strain rate deformation becomes homogeneous.[4] TPF based processing will be limited to a processing range where the metallic glass deforms homogenously. This range is defined by the processing temperature and strain rate, ". FIG. 1 shows schematically this processing region, which includes the glass transition temperature, Tg and the crystallization temperature, Tx. These temperatures are arbitrarily determined in heating experiments with a rate of typically 20 K/min. But as the figure indicates the temperature region is much larger depending on the strain rate. For example surface imprinting typically requires a low strain rate and strain, and can therefore be carried out at low temperatures whereas extrusion, injection molding, rolling require high temperatures (low relative viscosity) (FIG. 4). Thereby, the ideal processing conditions (t,T, ") for each step vary and can be optimized for multi-step processing to reduce $x_i$ and thereby $$\sum_{i=1}^{N} x_i.$$

The additive and cumulative characteristic of x(t,T) will be utilized in the homogeneous deformation region in multi-step processing methods to fabricate complex articles from metallic glasses (FIG. 3).

One example of our invention is in the fabrication of a main spring for a mechanical watch movement. A recent patent (PCT/CH2009/000191) application proposes to quench and deform the liquid metallic glass simultaneously to fabricate an amorphous metallic glass ribbon. Fabrication of metallic glass ribbons based on rapid liquid quenching is a well-established technology to fabricate very large quantities of magnetic iron based metallic glasses. This technique is highly optimized to fabricate thin, about 30 microns thick, ribbons in large quantities, but is not suited for the controlled and reproducible fabrication of ribbons of thickness around 100 microns (required for metallic glass main springs). This is due to the fact that during this so called melt-spinning processing step cooling and forming must occur simultaneous and rapidly. The fabrication of thin ribbons, ~30 microns is controlled by the surface tension which has a low temperature dependence whereas in order to fabricate thicker, ~100 microns samples, the deformation and final thickness is controlled by viscous flow which has a very strong temperature dependence. During the quenching process the viscosity increases by about 12 orders of magnitude and thereby leaves the process difficult to control.

In order to fabricate ribbons of required thickness of ~100 microns this invention utilized TPF based rolling of BMG feedstock material in its homogenous deformation region through a rolling process (FIG. 3). This process enables the reproducible fabrication of high quality ribbons with uniform thickness. This is due to:

- the decoupling of cooling (to avoid crystallization) and deformation
- no limitation in terms of ribbon thickness
- the intrinsic negligible scatter in $t_{cryst}$[3]
- external effects such as impurities have negligible effects on $t_{cryst}$[5]
- low flow stresses in the homogeneous deformation region (try to quantify with $\sigma=\eta 3\dot{\varepsilon}$ yet large enough that the turbulent and gravitational effects can be neglected (FIG. 5)[6]

The temperature and strain rate will be chosen such that homogeneous deformation will occur and that $x_1<x_{cryst}$. For example, in the case of the watch springs mentioned above, after fabricating the ribbons for the spring by TPF based rolling, various processing steps can be added after the TPF rolling process as long as $$\sum_{i=1}^{N} x_i = x_{cryst}$$

(FIG. 3). For example in order to cut the desired width for the spring from the ribbon after the rolling step, the ribbon can be reheated to $T_{hom}2$ and a scraping process can be applied to remove the excess material. Thereby the ribbon can be cut to result in a width required for the spring. In between the processing steps any operation can be done (e.g. grinding, polishing, elastic or plastic deformation) as long as $$\sum_{j=1}^{K} x_j = 0$$

(K: number of operations in between the TPF based processing steps). The shaping of the ribbon into a characteristic spring shape is carried out in processing step 3. This processing step (and any other processing step) can be carried out in any number of processing steps as long as $$\sum_{i=1}^{N} x_i < x_{cryst},\ x_i = \sum_{j=1}^{K} x_j.$$

Rolex (PCT/CH2009/000191, WO/2010/000081, Jan. 7, 2010) proposes to elastically deform the ribbon at room temperature and subsequently reheat the sample into a temperature region Tg−50<T<Tx+50 and relax the elastic stresses. This processing strategy has however limitations for the achievable deformations. The smallest radius of curvature that can be achieved through elastic deformation with a metallic glass ribbon (strain about 2% and thickness of a ribbon required for a main spring is about 100 microns) is given by $$r = \frac{2h}{\varepsilon} = \frac{0.2\ \text{mm}}{0.02} = 10\ \text{mm}.$$

The shape of an unloaded mainspring comprises of radii of curvature that are smaller than 10 mm. Therefore, the shape of the unloaded spring can not be achieved solely by elastic deforming the ribbon but plastic deformation is also required. Plastic deformation at room temperature under experimentally practical strain rates $>10^{-4}$ 1/sec results in shear localization which is concentrated in so called shear bands[4]. The formation of shear bands results in an alteration of the mechanical properties, stress concentrations, crack nucleation sites, and an increase in the roughness of the ribbon's surface. Our method circumvents such limitations. In our invention we deform the ribbon under conditions (temperature and strain rate) that results in homogenous deformation. Therefore:

- No practical limitations to the minimum radius that can be achieved
- No danger of shear localized plastic deformation forming shear bands
- Smooth surface of the ribbons is not negatively affected by this processing step.

After this shaping processing step other steps might be added. For example it might be beneficial to separate deformation steps into several steps which might or might not be carried out at the same temperature. For example if the required deformation varies significantly throughout the article, or if deformations are required into another plane. Further processing steps, for example a surface smoothening treatment can be applied as long as $$\sum_{i=1}^{N} x_i = x_{cryst}.$$

The final state of the article can be controlled by:

The cooling rate

A subsequent anneal

This invention can be used to create any complex shaped article where the finish product cannot be shaped from feedstock with one TPF step or where large-scale batch fabrication is required. This might be due to the necessity of differing processing parameters for the various operations or significant difference in strain within the article (from feedstock to final shape).

Other uses of our invention include: fabrication of watch cases where TPF based processing steps such as blow molding, local imprinting, local deformation are combined with possible steps in between which do not increase the crystallized volume fraction.

The invention also enables the addition of surface patterning and/or small features into larger articles. The necessary strains, strain rates, which are controlled by viscosity and pressure differential, change with feature size and aspect ratio. This means that the processing parameters required to realize all desired geometries and features in an article may not overlap. For example, thin, large aspect ratio geometries require large strains and are best carried out at relatively high viscosities where gravitational effects can be neglected. Smaller features that can be created with high strain rates but low strain can be added subsequently with localized, low viscosity forming. This also allows for more generic (less expensive) molds.

The invention also enables personalization of articles post bulk shaping. Articles such as watches, rings, biomedical implants etc can be molded to fit an individual, post manufacturing (for instance, ring sizing). Personalization also can include customization in terms of aesthetics (surface finish, etc).

The invention also enables creation of identifying features post bulk shaping. This includes TP numbering/lettering in lieu of engraving (which removes material). This also includes non replicable features such as holograms to prove authenticity.

The invention also enables bulk shaping of patterned surface. Typically, surface patterning is significantly easier to achieve on planar surfaces. We first pattern features on a planar BMG surface. Subsequently the patterned BMG can be formed through blow molding into a wide range of complex, non planar surfaces with low viscosity, low pressure forming, which preserves the features. Due to the orders of magnitude difference in length scale of the pattern and the article, the blow molding effect on the pattern is negligible, hence making this a two-step process.

The invention also enables joining of two previously bulk shaped articles. This includes permanent bonding of two separately TPFed articles as long as the process does not exceed the critical crystal volume faction for either article.

The invention also enables TP based finishing of previously bulk shaped articles. This includes the submersion of a shaped article into a heated liquid bath to smoothen the surface.

The invention also enables creation of parisons, preshapes, sheets for blowmolding. Some desired feedstock geometries, such as sheets, are difficult to cast. These geometries may be TPFed into preshapes and then blowmolded.

The invention also enables large scale batch fabrication of metallic glass devices. For example, an individual geometry like a hemisphere may be blow molded using feedstock that has not been processed prior to the actual blow molding. However, in a large scale batch fabrication, it may be necessary to use one large metallic glass sheet that has been TPFed as described previously. This sheet would then be placed on a fixture or mold that can TPF several of the same or different geometries at once.

The invention is illustrated further in the following non-limiting example.

Example 1

Example of the procedure to fabricate metallic glass coil spring like used for main springs in mechanical watch movements.

Alloy Making

Alloy with the composition $Pd_{43}Ni_{10}Cu_{27}P_{20}$, given in atomic percent, was made by homogenously melting preweighed constituent elements of at least 99.95% purity inside a quartz crucible under vacuum (~10 mTorr/$10^{-2}$ mbar), FIG. 6, using a radio-frequency (RF) water-cooled copper induction coil. After homogenous mixing of the melt, the alloy was allowed to cool in air. After solidification, the alloy was placed in a new quartz crucible. Powdered anhydrous $B_2O_3$ of approximately the same volume as the alloy was added to the crucible as flux. The alloy was then fluxed inside the quartz crucible at 1100 C for 10 minutes under +15 psig of ultra high purity (UHP) Ar followed by 5 minutes in vacuum (~10 mTorr/$10^{-2}$ mbar). The system was then left to cool in air. After removal of alloy from fluxing apparatus, the alloy will be sonicated in ACS grade methanol to remove any residual $B_2O_3$ Alloy Casting The alloy is cast using a quartz mold of 2-3 mm in diameter. The alloy is first melted under vacuum (~10 mTorr/$10^{-2}$ mbar) at 1100° C. for 2 minutes using a resistive furnace. Then +15 psig UHP Ar atmosphere is applied and the alloy should fill the mold. After 1 minute upon application of pressure, the whole mold is removed from the furnace and subsequently quenched in water at room temperature within 2 seconds. The as-cast alloy is removed from the water bath and the residual quartz is removed. If necessary, sand with 320 grit sand paper to remove any wetted quartz. Differential scanning calorimetry (DSC) measurements are carried out in ramp mode at 20° C./min from 50° C. to 450° C. to ensure the glass transition temperature ($T_g$) and crystallization temperature ($T_x$) are coherent with literature. DSC measurement for isothermal mode at 370° C. is measured to quantify alloy-processing time. FIG. 7 depicts the as-cast alloys. Residual quartz that is wetted on the surface of the alloy can be seen.

Sheet (Ribbon) Forming

Rollers for the rolling mill are made from hardened tool steel finished with 16000 grit buffing compound. The rollers and brass plate are heated to 350° C. The time we consume of the available processing time of about 15 minutes is about 1 minute. The rollers at 4 inches in diameter and are rolled at 1/25 rpm. The rollers are first set approximately 2 mm apart. After two passes at each gap size, the gap between the rollers is slowly reduced to the final desired thickness. The thickness is constantly monitored using a micrometer with at least 0.001 mm resolution. The final sheet is usually achieved after the twentieth pass. FIG. 8 is a photograph of the rolling mill used. The brass plate is used for preheating the compound and feeding the feedstock into the rollers.

Coil Forming

Molds machined from brass are used. The sheets, after being machined into the required dimensions (width and length, the thickness is given by the ribbon fabrication) are coiled into the geometry specified by the mold. Multiple molds maybe required for more complex geometries. After securing the sheets inside the mold, the mold is submerged in a salt bath (for example, Dynalene MS-1 or Dynalene MS-2) at 350° C. for twenty seconds. The processing step can also be carried out in air, however in a liquid bath temperature control is higher. This processing step can also be carried out at lower temperature down to 320° C. The mold is then removed from the bath and is quenched in water at room temperature. The coil is removed from the mold and the surface oxides could be removed by polishing with polishing paste. FIG. 9 is a photograph of a mainspring spiral made by the experiment of this example.

The present invention contemplates fabrication of articles singly or in batches. FIG. 10 illustrates two single piece blow-molding processes, while FIG. 11 diagram of a large scale or batch molding process. It is possible to have a wafer type mold that has hundreds of cavities. One must first create a BMG sheet sufficiently large to cover the wafer and then blow mold. The BMG sheet may be formed by a rolling process as discussed hereinabove with respect to ribbons, the sheet having much longer and wider dimensions. This allows the fabrication of hundreds of articles at once, which is required for large-scale commercialization.

REFERENCES

1. J. P. Patterson and D. R. H. Jones, Materials Research Bulletin 13 (6), 583-585 (1978).
2. J. Schroers, Advanced Materials 22, 1566-1597 (2010).
3. J. Schroers, Acta Materialia 56 (3), 471-478 (2008).
4. F. Spaepen, Acta Metallurgica 25 (4), 407-415 (1977).
5. J. Schroers, Y. Wu and W. L. Johnson, Philosophical Magazine a-Physics of Condensed Matter Structure Defects and Mechanical Properties 82 (6), 1207-1217 (2002).
6. R. Martinez, G. Kumar and J. Schroers, Scripta Materialia 59 (2), 187-190 (2008).

What is claimed is:

1. A process for thermoplastic forming of a metallic glass, the process comprising the steps of:

(a) providing an amorphous metallic glass feedstock, the feedstock comprising $Pd_{43}Ni_{10}Cu_{27}P_{20}$;

(b) heating the feedstock at a first temperature which is equal to or greater than the glass transition temperature of the feedstock so that the feedstock is in a super-cooled liquid state, thereby enabling a homogeneous first deformation treatment of the feedstock;

(c) discontinuing heating of the feedstock while the crystallized volume fraction of the feedstock is less than a predetermined crystallized volume fraction; and (d) after a predetermined interval during which cooling of the feedstock occurs, reheating the feedstock at a second temperature so that the feedstock is in a super-cooled liquid state, thereby enabling a homogeneous second deformation treatment of the feedstock; and (e) discontinuing reheating of the feedstock while the total crystallized volume fraction of the feedstock is less than said predetermined crystallized volume fraction.

2. The process of claim 1, further comprising subjecting the feedstock to the first deformation treatment during the heating of the feedstock, wherein the first deformation treatment is under conditions of temperature and strain rate that result in homogenous deformation, also comprising discontinuing the first deformation treatment while the crystallized volume fraction of the feedstock is less than said predetermined crystallized volume fraction.

3. The process of claim 1 wherein a minimal detectable crystallized volume fraction is between about 1% and about 10% of total feedstock volume.

4. The process of claim 1, further comprising quenching the feedstock or subjecting the feedstock to controlled cooling; and optionally annealing the feedstock.

5. The process of claim 1 wherein the heating and reheating of the feedstock are at approximately uniform temperatures.

6. The process of claim 1 wherein the heating and reheating of the feedstock occur for respective time periods, the first temperature and the second temperature being the same approximately uniform temperature over said time periods.

7. The process of claim 1 wherein the feedstock is heated in at least one of step (b) and (d) at an increasing temperature over two or more discrete time periods.

8. The process of claim 1 further comprising using x-ray diffraction or thermal analysis to determine the crystallized volume fraction of the feedstock during the heating and reheating of the feedstock.

9. The process of claim 1 wherein said predetermined crystallized volume fraction is a minimum detectable crystallized volume fraction.

10. The process of claim 1 further comprising subjecting the workpiece to a treatment process during the discontinuing of the heating of the feedstock, while the feedstock is maintained at a temperature less than the glass transition temperature, said treatment process being taken from the group consisting of quenching, controlled cooling, annealing and combinations thereof.

11. A process for the customization of an article comprised of an amorphous metallic glass, the process comprising subjecting the article to the process of claim 1 wherein the article serves as the amorphous metallic glass feedstock and wherein subsequent to the discontinuing of the reheating of the feedstock, feedstock dimensions are compared to at least one reference value and the feedstock undergoes steps (a)-(e) of claim 1 until differences between the feedstock dimensions and at least one reference value fall within a tolerance range.

12. The process of claim 1, further comprising repeating steps (d) and (e) at least one more time to enable deforming of the feedstock into a final predetermined geometry while maintaining the total crystallized volume fraction of the feedstock lower than the predetermined crystallized volume fraction.

13. The process of claim 1, further comprising subjecting the feedstock to the second-deformation treatment during the reheating of the feedstock, wherein the second deformation treatment is under conditions of temperature and strain rate that result in homogenous deformation, also comprising discontinuing the second deformation treatment while the crystallized volume fraction of the feedstock is less than said predetermined crystallized volume fraction.

14. A process for thermoplastic forming of metallic glass ribbons, the process comprising the steps of:

(a) providing an amorphous metallic glass feedstock;

(b) homogeneously treating the feedstock by heating the feedstock at a temperature which is equal to or greater than the glass transition temperature of the feedstock;

(c) discontinuing heating of the feedstock when the feedstock has a crystallized volume fraction of less than a predetermined value;

(d) after a predetermined interval, reheating the feedstock at a second temperature which is equal to or greater than the glass transition temperature of the feedstock so that the feedstock is in a supercooled liquid state, thereby enabling homogeneous deforming of the feedstock;

(e) during the reheating of the feedstock, while the feedstock is at said second temperature, subjecting the feedstock to homogeneous deformation in the form of rolling the feedstock into ribbons;

(f) either quenching the feedstock or subjecting the feedstock to controlled cooling; and (g) optionally annealing the feedstock, wherein during the heating and reheating of the feedstock, the feedstock exists as a supercooled liquid enabling homogenous deformation of the feedstock, and wherein the total crystallized volume fraction of the feedstock after the heating and reheating of the feedstock is lower than a preselected crystallized volume fraction.

15. The process of claim 14, wherein the feedstock is heated in step (b) at an approximately uniform temperature.

16. The process of claim 15, wherein the feedstock is heated in step (b) at an incrementally increasing temperature.

17. The process of claim 14, wherein the feedstock is heated in step (b) at an approximately uniform temperature over two or more discrete time periods.

18. The process of claim 14, wherein the feedstock is heated in step (b) at an incrementally increasing temperature over two or more discrete time periods.

19. The process of claim 14, wherein the metallic glass ribbon is adaptable for use as a main spring for a mechanical watch movement.

20. The process of claim 14, wherein subsequent to the step of rolling the feedstock to form ribbons, the ribbons are reheated and a scraping process is applied to the ribbons to remove excess material.

21. The process of claim 14, wherein: (1) subsequent to the step of homogeneously deforming the feedstock by heating the feedstock at a temperature which is equal to or greater than the glass transition temperature of the feedstock; and (2) prior to the step of discontinuing heating of the feedstock, the homogeneously deformed feedstock is subjected to one or more addition process steps selected from the group consisting of grinding, polishing, and elastic or plastic deformation.

* * * * *